United States Patent [19]

Mobley et al.

[11] Patent Number: 4,715,833

[45] Date of Patent: Dec. 29, 1987

[54] PIN AND SOCKET ELECTRICAL TERMINAL

[75] Inventors: Dewey F. Mobley, Lake Orion; Janice M. Warren, New Hudson, both of Mich.

[73] Assignee: Interlock Corporation, Westland, Mich.

[21] Appl. No.: 881,413

[22] Filed: Jul. 2, 1986

[51] Int. Cl.[4] ..... H01R 13/11

[52] U.S. Cl. ..... 439/834

[58] Field of Search ..... 339/258 R, 258 P

[56] References Cited

U.S. PATENT DOCUMENTS

| | | | |
|---|---|---|---|
| 2,894,240 | 7/1959 | Mautner | 339/258 R |
| 3,482,207 | 12/1969 | Cairns | 339/258 R |
| 4,120,557 | 10/1978 | Horrocks | 339/258 R |
| 4,431,256 | 2/1984 | Piscitelli et al. | 339/258 R |

*Primary Examiner*—Joseph H. McGlynn

*Attorney, Agent, or Firm*—Harness, Dickey & Pierce

[57] ABSTRACT

A pin and socket electrical terminal consisting of a pin member having a generally cylindrical section of predetermined diameter and a socket member having a tubular section of a size to receive the pin member therein so as to establish electrical conductivity therebetween. The socket member has three radially inwardly projecting and circumferentially spaced ribs terminating at their radially inner edges at positions located substantially on an imaginary circular path having a diameter slightly less than the pin diameter so that when the pin is inserted into the socket member tubular section, the ribs firmly engage the pin member so as to establish good electrical contact between the members. The tubular section has a longitudinal seam running its full length so that it can yield in a circumferential direction to accommodate the inserted pin member. A form of the invention is also disclosed in which the ribs are on the pin member.

9 Claims, 9 Drawing Figures

PIN AND SOCKET ELECTRICAL TERMINAL

BACKGROUND OF THE INVENTION

This invention relates generally to electrical terminals and more particularly to a pin and socket assembly for establishing improved electrical contact, thereby enabling significant downsizing of electrical connectors.

Pin and socket electrical terminals are in extensive use for a variety of purposes and are an essential component in many products. The object of this invention is to provide an improved pin and socket electrical terminal that has the capability for carrying high electrical currents for the size of the terminal. This capability provides for miniaturization.

SUMMARY OF THE INVENTION

The pin and socket assembly of this invention consists of a generally cylindrical pin member of predetermined diameter that is made by rolling flat metal stock into a cylindrical shape so that it is hollow, and a tubular socket member which is similarly formed from flat metal stock and is deformed so that it has three radially inwardly projecting and circumferentially spaced ribs. The ribs on the socket member terminate at their radially inner edges at positions located substantially on an imaginary circular path having a diameter that is slightly less than the pin diameter.

As a result, when the pin is inserted into the socket member, the inner edges of the ribs firmly engage the pin member so as to establish electrical contact between the pin and socket members. The ribs are provided at the inlet end of the socket member with inclined ramps to facilitate their firm engagement with the pin member. The three point engagement of pin and socket insures a tight, firm engagement of the terminal members assuring the desired flow of current therebetween.

The outer end of the socket member terminates in a double thickness guide section having an inner surface that is of progressively reducing diameter to facilitate insertion of the pin member, which has a tapered end to also facilitate insertion in the socket member.

The structural configuration of the terminal enables it to be formed of metal alloys that are high in copper and, accordingly, have high electrical conductivity and high thermal conductivity characteristics. These materials have stress relaxation characteristics which make them subject to a loose contact at higher temperatures.

By virtue of the structure of the socket member with a relatively short cantilevered tubular socket and the structure of the interfitting pin member with three equally spaced radial ribs, these stress relaxation characteristics of the material are not significant to the operation of the terminal.

The result is a pin and socket assembly which provides for improved electrical contact and improved current handling capabilities.

Further objects, features and advantages of the invention will become apparent from a consideration of the following description and the appended claims when taken in connection with the accompanying drawing in which:

Figure 3:
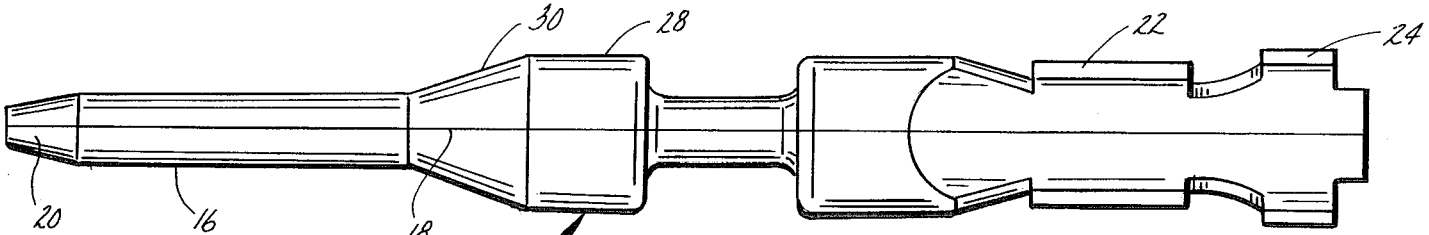
FIG. 3 is a top view of the pin member.
Figure 2:
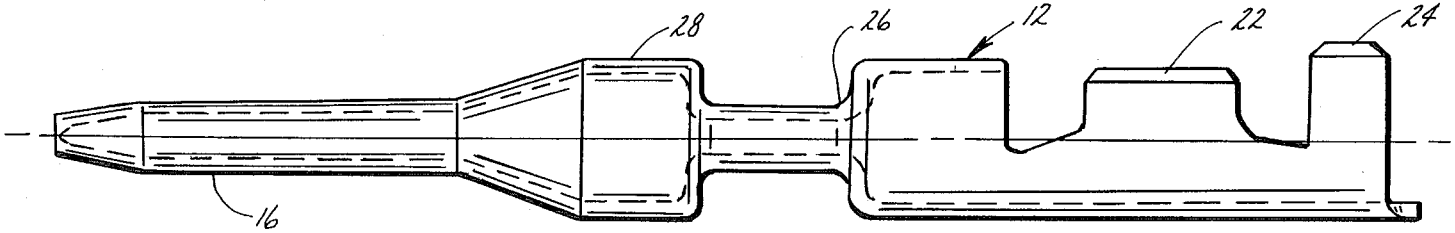
FIG. 2 is an enlarged side elevational view of the pin member in the assembly shown in FIG. 1.
Figure 4:
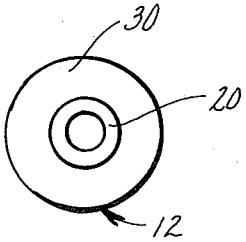
FIG. 4 is an end view of the pin member when viewed from the end of the pin member that is inserted in the socket member.
Figure 1:
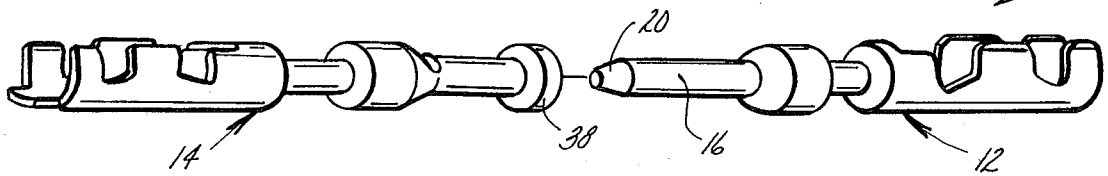
FIG. 1 is a perspective view of the pin and socket electrical terminal of this invention showing the pin in a position withdrawn from the socket.

With reference to the drawing, the pin and socket assembly of this invention, indicated generally at 10, is shown in FIG. 1 as consisting of a pin member 12 and a socket member 14 which are axially aligned prior to assembly as shown in FIG. 1. The pin member 12 includes a cylindrical pin section 16 which is hollow, as shown in FIG. 2, because the pin member 12 is formed from a flat sheet of electrically conductive metal, such as a copper alloy, which is rolled into the shape shown in FIGS. 2 and 3 in which it has a longitudinally extending seam 18 in its top side and terminates at one end in a tapered section 20 to facilitate insertion of the pin section 16 into the socket member 14.

The rear end of the pin member 12 is formed with conductor wings 22 and insulator wings 24 which are formed in pairs and are crimped into engagement with the conductor and the insulation surrounding the conductor, respectively, that is assembled with the pin member 12 (not shown). The conductor is stripped of insulation at one end and positioned between the grips 22 which are crimped onto the conductor to insure a firm electrical connection between the conductor and the pin member 12. The grips 24 are crimped onto the insulation to hold the conductor and the pin 12 in assembly relation.

Between the grips 22 and the pin section 16, the pin member 12 is formed with structural connection sections 26 and 28.

Figure 5:
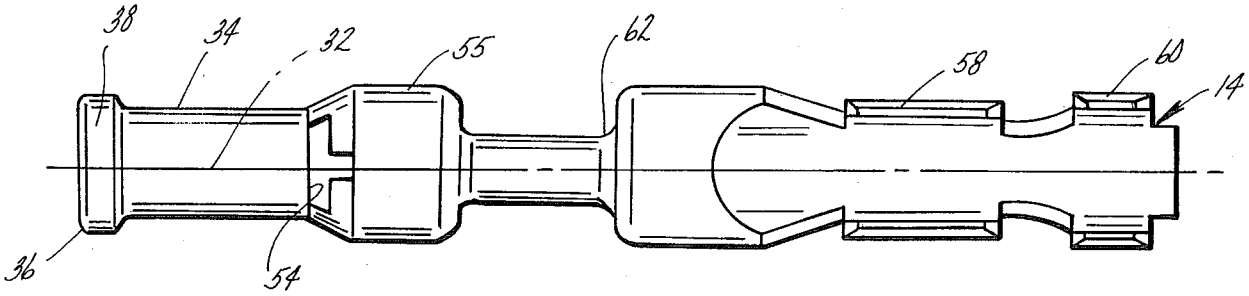
FIG. 5 is a top view of the socket member in the assembly shown in FIG. 1.
Figure 6:
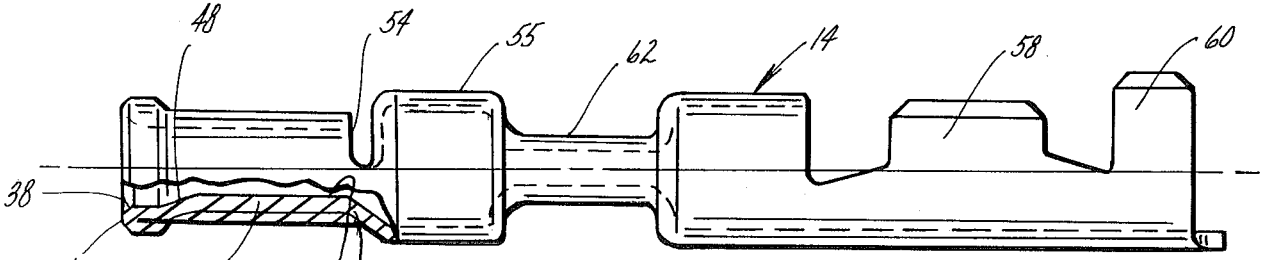
FIG. 6 is a side elevational view of the socket member shown in FIG. 5.

The socket member 14 (FIGS. 5, 6 and 7) is similarly formed by rolling a flat metal sheet of electrically conductive metal such as a copper alloy, so that it likewise has a longitudinal seam 32 in its top side. The socket member 14 has a tubular socket section 34 adjacent its inner end 36 which forms a guide section 38 for receiving the pin section 16 of the pin member 12. As shown is FIGS. 6 and 8, the guide section 38 is folded back on itself so that it is of double thickness for strength purposes and to facilitate insertion in connector assemblies. The section 38 has its inner surface shaped so that it is of a progressively reduced diameter in a direction inwardly of the tubular section 34 to provide for ease of insertion of the pin member 12 into the socket member 14.

Figure 8:
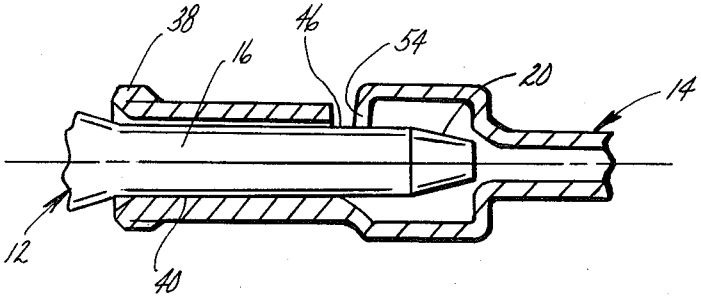
FIG. 8 is a fragmentary sectional view showing the pin member inserted in the socket member.

Inwardly of the guide section 38, the inner surface of the tubular section 34 is provided with three, equally spaced, inwardly directed ribs 40 which terminate in inner edges 42 disposed on an imaginary circle 44 that is of a reduced diameter relative to the diameter of the pin section 16, as shown in FIG. 8. It is to be understood that three ribs 40 are shown and three are preferred but it is within the purview of the invention to employ more than three ribs 40. As a result, when the pin member 16 is inserted into the tubular section 34, as shown in FIG. 8, the ribs 40 firmly engage the outer surface 46 of the pin section 16.

Figure 7:
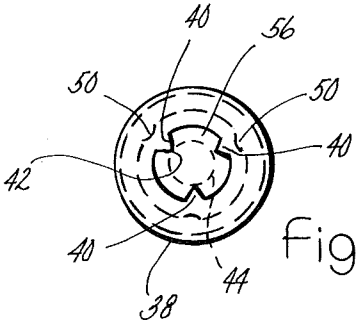
FIG. 7 is an end view of the socket member shown in FIG. 6.

The ribs 40 are provided at their ends adjacent the guide section 38 with inclined edges 48 which are sloped radially outwardly to form ramps that facilitate engagement of the tapered end section 20 of the pin section 16 with the ribs 40. As shown in FIG. 7, the outer surface of the tubular section 34 is provided with deformed or depressed areas 50 to form the radially inwardly extending ribs 40 which are spaced apart substantially equally in a direction circumferentially of the inner surface of the tubular section 34.

The tubular section 34 is structurally supported on an enlarged tubular section 55 by a support section 57 formed by a slot 54 in the socket member 14 adjacent the section 55. The relatively short length of the tubular section 34, and the location of the opening 54 so that both ends of the section 34 are free at the seam 32, enables the section 34 to yield at the seam 32 to accommodate insertion of the pin 12. This assures firm contact of pin 12 and socket 14. Air pockets 56 are formed between the ribs 40 and about the pin section 16 (FIGS. 7 and 8). The pockets 56 open at one end to the opening 54 and at the opposite end to the end 36 of the socket member 14 and may assist in preventing undue temperature rises in the terminal 10.

Rearwardly of the tubular section 55, the socket member 14 is formed with grips 58 and 60 that are arranged in pairs like the grips 22 and 24 previously described. Between the tubular section 55 and the grips 58 and 60, the socket member 14 is formed with a tubular structural section 62.

In the use of the pin and socket assembly 10 of this invention, the pin and socket members 12 and 14 are attached to the usual insulated conductors (not shown) and mounted in fixed or movable positions in which one of the members 12 and 14 can be moved relative to the other to position the members in the aligned positions shown in FIG. 1 in which the pin member 12 can be inserted in the socket member 14. During insertion, the ribs 40 firmly engage the outer cylindrical surface of the pin section 16 to establish improved electrical contact between pin and socket. This establishes an interface with improved ability to dissipate heat and high current carrying capabilities. In addition the structure of the terminal 10 enables it to be formed of a material which generates less heat. The result is an improved dry circuit terminal which can be miniaturized.

Figure 9:
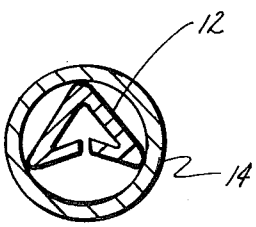
FIG. 9 is a transverse sectional view illustrating a modified form of the electrical terminal of this invention.

It should be appreciated that the advantages in this invention pointed out above wherein the ribs 40 are provided on the socket member 14 to provide minimum friction forces between the pin 12 and socket 14 during insertion and withdrawal while achieving high engagement forces in directions perpendicular to the ribs 40 to insure good electrical characteristics and gas tight engagement between pin and socket can also be achieved by placing the ribs on the pin instead of the socket, as shown in the modified form of the invention illustrated in FIG. 9.

In the modified socket assembly **10*a* shown in FIG. 9, the pin member 12*a*, formed like the pin member 12, is shaped so that it has three ribs 40*a* which engage the inner cylindrical surface of the socket member 14*a*. In all other respects the assembly 10*a* is like the assembly 10**.

From the above description, it is seen that this invention provides an improved pin and socket assembly 10 for establishing electrical contact which, by virtue of its structure, provides improved performance characteristics.

What is claimed is:

1. A pin and socket assembly for establishing electrical contact comprising a pin member and a hollow socket member of a size and shape to enable insertion of said pin member into said socket member, one of said members having integral radially projecting and circumferentially spaced ribs and the other one of said members having a generally cylindrical surface engageable with said ribs, said ribbed member having a single longitudinal seam and an annular wall cross section continuous on either side of said longitudinal seam, said ribs terminating in edges located substantially on an imaginary circular path having a diameter such that when said pin member is inserted into said socket member said edges of said ribs firmly engage said cylindrical surface so as to establish electrical contact between said members.

2. A pin and socket assembly according to claim 1 wherein said ribs are formed on said socket member and extend radially inwardly.

3. A pin and socket assembly according to claim 1 wherein said ribs are formed on said pin member and extend radially outwardly.

4. A pin and socket assembly for estabilishing electrical contact comprising a pin member having a generally cylindrical section of predetermined diameter and a socket member having a tubular section, said tubular section having an annular wall cross section continuous on either side of a single longitudinal seam said tubular socket member section having integral radially inwardly projecting and circumferentially spaced ribs, said ribs terminating at their radially inner edges at positions located substantially on an imaginary circular path having a diameter so that when said pin is inserted into said tubular socket member section said edges of said ribs firmly engage said pin member so as to establish continuous metal to metal electrical contact between said members.

5. A pin and socket assembly according to claim 4 wherein the socket member is provided with at least three of said ribs.

6. A pin and socket assembly according to claim 4 wherein said tubular socket member section has an open inlet end through which said pin member is inserted to establish contact, said tubular socket member section comprising a metal sheet bent into an annular tube shape, said tubular socket member section being structurally supported at the opposite end and having a single longitudinal seam enabling said tubular section to yield elastically and expand in a radial direction to accommodate said pin member.

7. A pin and socket assembly according to claim 6 wherein said socket member tubular section has a pair of free ends and said seam extends the full length of said section between said ribs.

8. The pin and socket assembly according to claim 6 wherein said inlet end of said socket member terminates in a guide section, said guide section having an inner surface which is of a progressively reduced diameter in a direction inwardly of said socket member toward said ribs.

9. The pin and socket assembly according to claim 8 wherein said guide section is thicker than said tubular socket member section having said ribs.

* * * * *